US010850501B2

(12) United States Patent
Hatanaka et al.

(10) Patent No.: US 10,850,501 B2
(45) Date of Patent: Dec. 1, 2020

(54) PRINTING METHOD AND PRINTING APPARATUS

(71) Applicant: SEIKO EPSON CORPORATION, Tokyo (JP)

(72) Inventors: Yuji Hatanaka, Shiojiri (JP); Yusuke Nakazawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/034,066

(22) Filed: Jul. 12, 2018

(65) Prior Publication Data

US 2019/0016124 A1 Jan. 17, 2019

(30) Foreign Application Priority Data

Jul. 14, 2017 (JP) ..... 2017-137773

(51) Int. Cl.
*B41J 2/165* (2006.01)
*B41J 2/045* (2006.01)
*B41J 2/21* (2006.01)

(52) U.S. Cl.
CPC ..... *B41J 2/04508* (2013.01); *B41J 2/04581* (2013.01); *B41J 2/16517* (2013.01); *B41J 2/16579* (2013.01); *B41J 2/2142* (2013.01)

(58) Field of Classification Search
CPC .. B41J 29/393; B41J 2/04508; B41J 2/16517; B41J 2/16579; B41J 2/2142; B41J 2/04581
See application file for complete search history.

(56) References Cited

U.S. PATENT DOCUMENTS 8,167,425 B2 * 5/2012 Nakamaki ..... B41J 2/16579 347/107
2004/0057768 A1 * 3/2004 Oshino ..... B41J 2/32 400/103
2009/0225119 A1 * 9/2009 Huyghen ..... B41J 2/16579 347/14
2013/0083107 A1 * 4/2013 Nishikawa ..... B41J 2/0451 347/10
2013/0122186 A1 * 5/2013 Hoppel ..... B05B 12/12 427/8

FOREIGN PATENT DOCUMENTS

JP 2016-135557 A 7/2016

* cited by examiner

*Primary Examiner* — Sharon A. Polk
(74) *Attorney, Agent, or Firm* — Chip Law Group

(57) ABSTRACT

A printing apparatus and a printing method that make it easy to visually confirm whether a printing defect has occurred are provided. A printing method according to an application example includes printing of image in which an image is printed onto a medium by a printing apparatus, detecting of state in which a state change is detected during operations of the printing apparatus in the printing of image, and printing of information in which state change information is printed onto the medium, based on the state change detected in the detecting of state. The state change information is associated with a position in the image where the state change is detected.

20 Claims, 9 Drawing Sheets

PRINTING METHOD AND PRINTING APPARATUS

BACKGROUND

1. Technical Field

The disclosure relates to a printing method and a printing apparatus.

2. Related Art

A printing apparatus that prints an image by ejecting ink droplets onto a medium is known. In such a printing apparatus, it is conceivable to print a pattern for confirming ink droplet ejection errors onto the medium, in cooperation with an error detection operation for detecting whether an ink droplet ejection error has occurred (see JP-A-2016-135557, for example). Through this, a user can confirm and determine whether an ejection error severe enough to impact actual use has occurred.

To determine whether an ejection error severe enough to impact actual use has occurred, it is necessary to confirm whether the printed image indicates a state that will impede actual use. Thus, the user needs to look at the entire range of the printed material and confirm whether there are printing defects.

However, with the method in which the user visually confirms the entire area of the printed material, the confirmation takes time, and it is easy to overlook printing defects when there is a large area to be confirmed. Although a method in which an image of the printed material is captured by an imaging device and printing defects are detected by comparing the image data with print data is conceivable, doing so may increase the size of the apparatus and increase costs.

SUMMARY

The disclosure provides a printing method and a printing apparatus capable of determining a position where a printing defect may have occurred, that make it easy for a user to confirm visually the present or absence of printing defects.

The disclosure can be realized as the following aspects or application examples.

Application Example

A printing method according to an application example includes printing of image in which an image is printed onto a medium by a printing apparatus, detecting of state in which a state change is detected during an operation of the printing apparatus in the printing of image, and printing of information in which state change information is printed onto the medium, based on the state change detected in the detecting of state. The state change information is associated with a position in the image where the state change is detected.

According to this method, a state change occurring while the image is being printed is detected, and the state change information is associated with a position in the image where the state change is detected. In other words, the state change information is printed onto the medium in a manner that the position is identifiable where the state change is detected. Accordingly, a position in a printed material where a printing defect may have occurred can be determined from the printed state change information. Accordingly, a user can easily visually confirm a presence of a printing defect in the printed material, reducing the possibility of overlooking a printing defect.

Application Example

In the above-described application example, the state change information can identify contents of the state change.

According to this method, since the state change information can identify the contents of the state change, the user can understand the contents of the state change from the state change information. Accordingly, the user can confirm the printed material under paying attention to the contents of the printing defect that may have occurred. As a result, there is an even lower possibility that a printing defect will be overlooked.

Application Example

In the above-described application example, the printing of image may include printing the image by ejecting liquid droplets, and the detecting of state may include detecting an error in which the liquid droplets have not been ejected.

According to this method, the error in which liquid droplets have not been ejected is detected, thus the state change information can include information about the possibility in that missing printing ("missing dots" hereinafter) has occurred.

Application Example

In the above-described application example, the detecting of state may include detecting an interrupt of the printing due to a maintenance operation for the printing apparatus.

According to this method, the interrupt of the printing due to a maintenance operation for the printing apparatus is detected, thus the state change information can include information about the interrupt of the printing due to a maintenance operation.

Application Example

In the above-described application example, the detecting of state may include detecting whether an ejection head ejecting liquid droplets has contacted with the medium.

According to this method, whether the ejection head has contacted with the medium ("head friction" hereinafter) is detected, thus the state change information can include information about the head friction.

Application Example

In the above-described application example, the printing of information may include printing the state change information each time the state change is detected.

According to this method, the state change information is printed onto the medium each time a state change is detected. The detecting of state is executed in the printing of image, thus the state change information is printed corresponding to a position in the printed image (printed material) where the state change is detected. As a result, the user can know the position where a printing defect could have occurred from the position where the state change information is printed.

Application Example

In the above-described application example, the printing of information may include printing the state change information after the end of the printing image.

According to this method, the state change information is printed onto the medium after the end of the printing image (i.e., after the image has been formed). Accordingly, since the state change information is printed all together, the readability of the state change information is improved.

Application Example

In the above-described application example, the printing of information may include printing the state change information as text.

According to this method, the state change information is printed as text, thus the user can know contents of the state change from that text information. Accordingly, the user can accurately understand what printing defect may have occurred.

Application Example

In the above-described application example, the printing of information may include printing the state change information as a graphic.

According to this method, the state change information is printed as a graphic, thus the user can know the contents of the state change from that graphic. Accordingly, the user can quickly understand visually what printing defect may have occurred.

Application Example

A printing apparatus according to an application example includes a printing unit configured to print an image onto a medium, a state detecting unit configured to detect a state change while the printing unit prints the image, and a controller configured to cause the printing unit to print the state change information onto the medium based on the state change detected by the state detecting unit. The controller is configured to control the printing unit such that the state change information is associated with a position in the image where the state change is detected.

According to this configuration, the controller of the printing apparatus detects a state change while the printing unit is operating, and the controller is configured to control the printing unit such that the state change information is associated with a position in the image where the state change is detected. In other words, the controller is configured to control the printing unit such that state change information onto the medium is printed in a manner that a position can be determined where the state change is detected. Accordingly, a position in a printed material where a printing defect may have occurred can be determined from the state change information. Accordingly, a user can easily confirm a presence of a printing defect in the printed material visually, and the possibility of overlooking a printing defect is reduced.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Exemplary Embodiment

Figure 1:
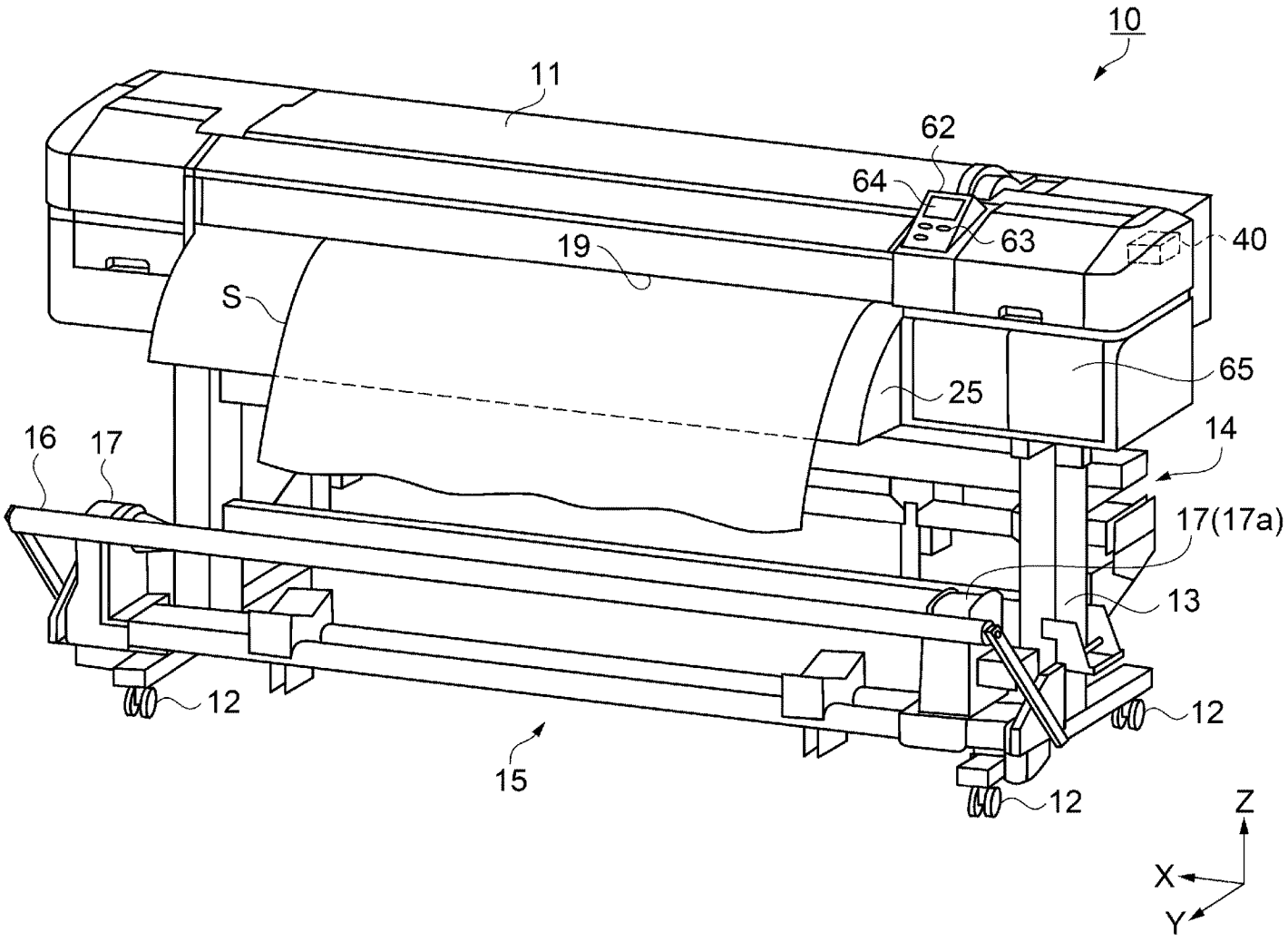
FIG. 1 is a perspective view illustrating an overall configuration of a printing apparatus according to the disclosure.

Some exemplary embodiments of a printing method and a printing apparatus 10 in which the disclosure is applied will be described below while referencing the accompanying drawings. One exemplary embodiment will be described with a Large Format Printer (LFP) as an example of the printing apparatus 10. For the sake of convenience, three mutually-perpendicular axes are indicated as an X axis, a Y axis, and a Z axis in the drawings. The pointed end of the arrow indicating the direction of each axis is a "+ side", and the base end is a "− side". A direction parallel to the X axis is an "X axis direction"; a direction parallel to the Y axis is a "Y axis direction"; and a direction parallel to the Z axis is a "Z axis direction". In one exemplary embodiment, an up-down direction along the direction of gravity is the Z axis, and the +Z axis side is "up". A lengthwise direction of the printing apparatus 10 perpendicular to the Z axis direction (see FIG. 1; a left-right direction when viewing the drawing normally) is the X axis, and the +X axis side is "left". The direction perpendicular to the Z axis direction and the X axis direction is the Y axis, and the +Y axis side is "front". A positional relationship along a transport direction of a printing medium S, which is a medium onto which an image is printed, is also "upstream" and "downstream". In one exemplary embodiment, the printing medium S is transported from a rear side, which is the −Y axis side, toward a front side, which is the +Y axis side, thus in this case the −Y axis side is "upstream" and the +Y axis side is "downstream". In the drawings referred to in the following descriptions, the vertical/horizontal scale of members included in the apparatus or parts of the configuration of the apparatus may be illustrated as being different from the actual scale, to simplify the descriptions and drawings. Constituent elements aside from those needed for the descriptions may be omitted from the drawings as well.

Configuration of Printing Apparatus

Figure 2:
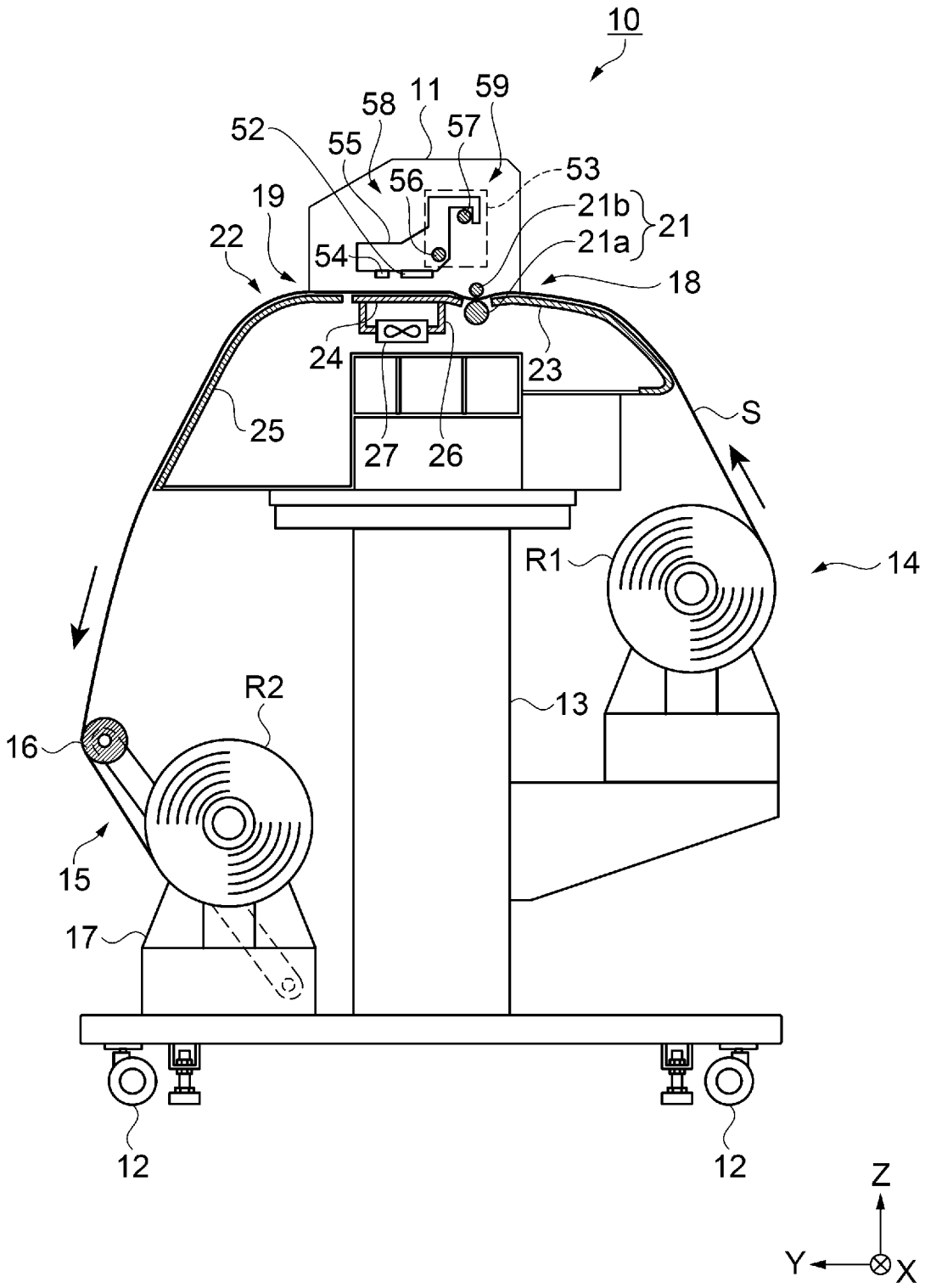
FIG. 2 is a cross-sectional diagram illustrating an internal configuration of a printing apparatus.

FIG. 1 is a perspective view illustrating an overall configuration of a printing apparatus 10 according to one exemplary embodiment. FIG. 2 is a cross-sectional diagram illustrating an internal configuration of the printing apparatus 10. The configuration of the printing apparatus 10 will be described with reference to FIGS. 1 and 2.

The printing apparatus 10 receives print data from a host computer 100, which is an external device (see FIG. 5), and prints an image (including information such as text) corresponding to the print data onto a printing medium S by ejecting an ink composition (simply "ink" hereinafter) as droplets ("ink droplets" hereinafter) onto the printing medium S on the basis of the print data. The print data is image format date obtained by converting image data formed by a digital camera or the like (e.g., RGB digital image information) into a data format that can be printed by an application and a printer driver provided the host computer 100 in the printing apparatus 10, and includes commands for controlling the printing apparatus 10.

As illustrated in FIGS. 1 and 2, the printing apparatus 10 includes a transport unit 21 that transports the printing medium S, a medium feed unit 14 that feeds the printing medium S, which is in a roll, to the transport unit 21, a printing unit 58 that prints an image onto the transported printing medium S, and a medium take-up unit 15 that takes up the printed printing medium S into a roll. The printing unit 58 is provided inside of a substantially parallelepiped housing unit 11. These units are supported by a pair of legs 13, with a wheel 12 being attached to a lower end of each leg 13.

As illustrated in FIG. 2, the medium feed unit 14 is provided on a rear side (the −Y axis direction) of the housing unit 11. The medium feed unit 14 holds a roll body R1 in which unused printing medium S is wound into a cylindrical shape. Note that rolls R1 of multiple sizes, having different printing medium S widths (lengths in the X axis direction), numbers of winds, and the like, are interchangeably loaded on the medium feed unit 14. When the medium feed unit 14 on which the roll body R1 is loaded rotates counter-clockwise in FIG. 2, the printing medium S is unwound from the roll R1 and fed toward the printing unit 58. In one exemplary embodiment, the roll body R1 is an outward-wound roll in which the printing medium S is wound so that a printed surface on which the image is printed is on the outer side. The types of the printing medium S used in the printing apparatus 10 are broadly separated into paper and film. Woodfree paper, cast coated paper, art paper, coat paper, and the like can be given as specific examples of the paper, and synthetic paper, polyethylene terephthalate (PET), polypropylene (PP), and the like can be given as specific examples of the film.

The medium take-up unit 15 is provided on a front side (the +Y axis direction) of the housing unit 11. A roll body R2 that takes up the printing medium S printed onto by the printing unit 58 into a cylindrical shape is formed in the medium take-up unit 15. The medium take-up unit 15 includes a pair of holders 17 between which a core member for taking up the printing medium S and forming the roll body R2 is held. One holder 17*a* includes a winding motor (not illustrated) that imparts rotational force on the core member. When the winding motor is driven, and the core member rotates, the printing medium S is taken up onto the core member and the roll body R2 is formed. The medium take-up unit 15 includes a tension roller 16 that presses onto an opposite surface from the printed surface of the printing medium S, which sags under its own weight, and imparts tension on the printing medium S taken up by the medium take-up unit 15. Note that in the printing apparatus 10, it is also possible for the printing medium S to be discharged without being taken up into the roll body R2. For example, the printed printing medium S may be held in a discharge basket or the like (not illustrated) arranged on the front side of the housing unit 11.

As illustrated in FIG. 2, the printing apparatus 10 includes an upstream side support unit 23, a platen 24, and a downstream side support unit 25 that support the printing medium S transported by the transport unit 21 from below. The upstream side support unit 23 is provided on the rear side of the housing unit 11, and guides the printing medium S fed from the medium feed unit 14 to the transport unit 21. The platen 24 is provided at a position facing the printing unit 58, and supports the printing medium S during printing. For example, as illustrated in FIG. 2, the platen 24 includes a pressure chamber 26 having a box shape, and a suction fan 27 for discharging gas within the pressure chamber 26 to the exterior is provided in a bottom face of the pressure chamber 26. The printing medium S is suctioned onto the platen 24 by driving the suction fan 27 and maintaining negative pressure within the pressure chamber 26, thus correcting lifting caused by curls and the like of the printing medium S. The downstream side support unit 25 is provided on the front side of the housing unit 11, and guides the printed printing medium S from the platen 24 to the medium take-up unit 15. Thus, the upstream side support unit 23, the platen 24, and the downstream side support unit 25 form a transport path 22 of the printing medium S.

The transport unit 21 extends in a direction intersecting with the transport direction of the printing medium S, and is provided between the platen 24 and the upstream side support unit 23. The transport unit 21 is a transport roller pair including a rotationally-driving transport driving roller 21*a* disposed below the transport path 22, and a transport driven roller 21*b* that is disposed above the transport driving roller 21*a* and rotates under the rotation of the transport driving roller 21*a*. The transport driven roller 21*b* is configured to be capable of moving away from and coming into pressure contact with the transport driving roller 21*a*. While the transport driving roller 21*a* and the transport driven roller 21*b* comes into pressure contact, the transport unit 21 (the transport roller pair) feeds the printing medium S to the printing unit 58 in the transport direction (the +Y axis direction) while sandwiching (nipping) the printing medium S. A transport motor (not illustrated) serving as a power source that outputs rotational driving force to the transport driving roller 21*a* is provided inside the housing unit 11. When the transport motor is driven under the control of a unit control section 44 (see FIG. 5) and the transport driving roller 21*a* is rotationally driven, the printing medium S sandwiched between the transport driven roller 21*b* and the transport driving roller 21*a* is transported in the transport direction.

As illustrated in FIG. 1, an operation panel 62 is provided in an upper part of the housing unit 11 in the −X axis direction. The operation panel 62 includes a display unit 64 that displays a printing condition setting screen and the like, and an operation unit 63 operated when inputting printing conditions and the like and making various types of instructions. The printing conditions and various types of instructions input through the operation unit 63 are sent to a controller 40 and processed. An ink attachment unit 65 to which an ink receptacle (not illustrated) capable of holding ink can be attached is provided in a lower part of the housing unit 11 in the −X axis direction. A plurality of ink receptacles, each corresponding to a type, color, or the like of ink, are attached to the ink attachment unit 65. Furthermore, the controller 40 that controls the operations of the various units of the printing apparatus 10 is provided inside the housing unit 11.

Printing Unit

As illustrated in FIG. 2, the printing unit 58 is provided within the housing unit 11. A supplying port 18 for feeding the printing medium S to the printing unit 58 is provided in a position above the upstream side support unit 23 on the rear side (the −Y axis side) of the housing unit 11. A discharging port 19 for discharging the printing medium S printed onto by the printing unit 58 is provided in a position above the downstream side support unit 25 on the front side (the +Y axis side) of the housing unit 11.

The printing unit 58 is disposed above the platen (on the +Z axis side) and extends in the width direction of the printing medium S (the X axis direction). The printing unit 58 includes an ejection head 52 that ejects ink onto the printing medium S fed from the medium feed unit 14 and transported along the upstream side support unit 23 and the platen 24, a carriage 55 in which the ejection head 52 is mounted, and a head moving section 59 that moves the carriage 55 in a main scanning direction that intersects with the transport direction (the X axis direction).

The head moving section 59 moves the carriage 55 in the main scanning direction. The carriage 55 is supported on guide rails 56 and 57 disposed along the main scanning direction, and is configured to be capable of being moved back and forth in the main scanning direction by the head moving section 59. The ejection head 52 moves back and forth along the X axis direction together with the carriage 55. The head moving section 59 will be described in detail later with reference to FIG. 3.

An adjustment mechanism 53 that changes a height (position in the Z axis direction) of the ejection head 52 in order to adjust a distance between the ejection head 52 and the printing medium S is provided on each of both end portions of the guide rails 56 and 57 in the X axis direction. A reflection sensor 54 that senses the paper width (the length of the X axis direction) of the printing medium S is provided in a lower part of the carriage 55, in a position downstream (the +Y axis side) from the ejection head 52 in the transport direction.

The reflection sensor 54 is an optical sensor including a light source unit and a light receiving unit. The light source unit emits light downward, and the light receiving unit receives resulting reflected light. A detection value (voltage value) based on the intensity of the reflected light received by the light receiving unit is output to the controller 40. The reflection sensor 54 carries out the detection while the carriage 55 is moved in the main scanning direction, and the controller 40 calculates the width of the printing medium S by sensing positions where the reflection changes on the basis of the detection value, i.e., the positions of both ends portions of the printing medium S in the X axis direction. Printing is carried out by the ejection head 52 ejecting ink supplied from the ink receptacle onto the printing medium S transported along the transport path 22 in accordance with the calculated width of the printing medium S. The printed printing medium S is guided diagonally downward along the downstream side support unit 25 and is taken up by the medium take-up unit 15.

Although one exemplary embodiment describes a configuration of the printing apparatus 10 in which a long printing medium S is fed through a roll-to-roll method, the configuration is not limited to this method. For example, the printing apparatus 10 may be configured so that single pieces of paper pre-cut to predetermined lengths are fed as sheets, or may be configured so that the printed printing medium S is held in a discharge basket and the like (not illustrated) provided instead of the medium take-up unit 15. Additionally, a plurality of rolls R1 may be loaded on the medium feed unit 14 at the same time, and a plurality of printing media S may be printed onto by the printing unit 58.

Head Moving Section

Figure 3:
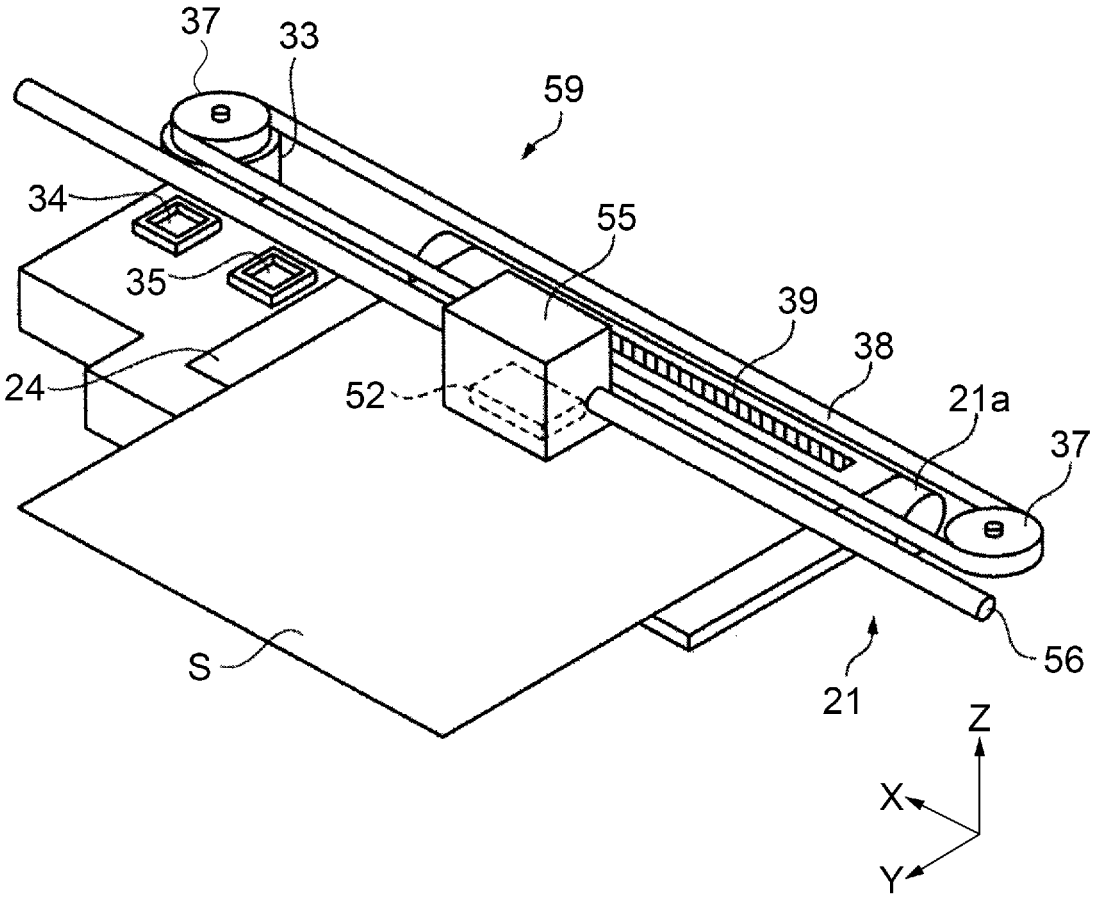
FIG. 3 is a diagram illustrating an example of a configuration of a head moving section.

A configuration of the head moving section 59 will be described next with reference to FIG. 3. FIG. 3 illustrates one example of the configuration of the head moving section 59 in the printing apparatus 10.

The head moving section 59 includes the guide rails 56 and 57 (see FIG. 2; the guide rail 57 is not illustrated in FIG. 3), the carriage 55, a timing belt 38, and a carriage motor 33. The guide rails 56 and 57 are provided within the housing unit 11 extending horizontally in the X axis direction. The ejection head 52 is mounted in the carriage 55, and the carriage 55 is disposed so as to move back and forth (scan) horizontally in the X axis along the guide rails 56 and 57 while being supported by the guide rails 56 and 57.

The timing belt 38 is disposed to the rear of the guide rail 56, and is wrapped around a pair of pulleys 37. One of the pulleys 37 is connected to a rotating shaft of the carriage motor 33. The timing belt 38 is capable of traveling freely between the two pulleys 37 parallel to the guide rail 56. Part of the timing belt 38 is connected to the carriage 55. Accordingly, when the carriage motor 33 operates under the control of the unit control section 44 (see FIG. 5), the carriage 55 is moved in the main scanning direction (the X axis direction).

Furthermore, a linear scale 39 is disposed in the X axis direction parallel to the guide rail 56. The linear scale 39 includes a transparent main body and light-shielding bands formed at constant intervals in the X axis direction. The carriage 55 includes a CR position detecting section 80 (see FIG. 5) provided with an optical sensor (not illustrated) that detects the light-shielding bands of the linear scale 39. A detection result from the CR position detecting section 80 is transmitted to a computational processing section 42, and a movement amount of the carriage 55 is detected accurately.

In this manner, an image is formed on the printing medium S by the ejection head 52 ejecting ink droplets during precise scanning (movement) by the head moving section 59. Hereinafter, an area of the printing medium S where the image is formed is an "image formation region", and the other area is a "non-image formation region".

Maintenance Unit

The carriage 55 is capable of moving past the printing medium S in the +X axis direction, and a flushing section 35 and a cap section 34 are disposed in that order, as a maintenance unit, in an area outside of the platen 24 in the +X axis direction. The ejection head 52 is moved to the position of the flushing section 35, the cap section 34, and the like by the carriage motor 33 operating in response to a control command from the unit control section 44. For example, flushing is carried out by moving the carriage 55 (the ejection head 52) to the flushing section 35 and causing ink to be ejected from nozzles. The flushing section 35 absorbs the ejected ink. Thickened ink can be removed from the ejection head 52 through such a flushing process.

The cap section 34 seals a bottom surface (a nozzle surface) of the ejection head 52 in an airtight state while the printing apparatus 10 is idle and prevents ink from thickening or hardening in the nozzles of the ejection head 52.

In one exemplary embodiment, the flushing section 35 is provided on one outer side of the platen 24, as illustrated in FIG. 3. However, this is not limited, and the flushing section 35 may be provided on both outer sides of the platen 24. The maintenance unit may be disposed in an area outside of the platen 24 in the −X axis direction.

Ejection Head

Figure 4:
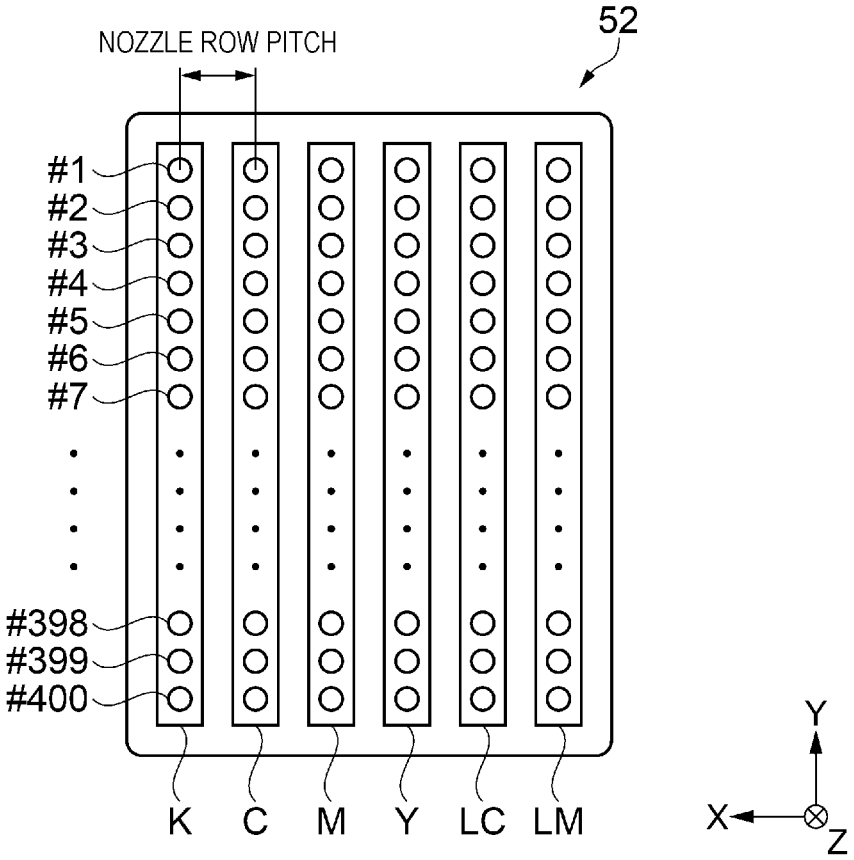
FIG. 4 is a diagram illustrating an example of a nozzle arrangement in an ejection head.

The configuration of the ejection head 52 will be described next with reference to FIG. 4. FIG. 4 is a schematic diagram illustrating one example of a nozzle arrangement when the nozzle surface of the ejection head 52 is viewed from the −Z direction. As illustrated in FIG. 4, the ejection head 52 includes nozzle rows, each formed by arranging a plurality of nozzles for ejecting a corresponding color of ink (in the example illustrated in FIG. 4, a black ink nozzle row K, a cyan ink nozzle row C, a magenta ink nozzle row M, a yellow ink nozzle row Y, a light cyan ink nozzle row LC, and a light magenta ink nozzle row LM, each including 400 nozzles, from #1 to #400). The nozzle rows are arranged at constant intervals (a nozzle row pitch) along the X axis direction (a scanning direction), and the plurality of nozzles (#1 to #400) in each nozzle row are arranged at constant intervals along the Y axis direction (the transport direction). Each nozzle is provided with a driving element (e.g., a piezoelectric element, not illustrated) that drives the nozzle and causes an ink droplet to be ejected. Accordingly, a 400-line image is formed on the printing medium S by the ejection head 52 ejecting ink droplets onto the printing medium S while being moved in the main scanning direction (the X axis direction).

Printing Apparatus System

Figure 5:
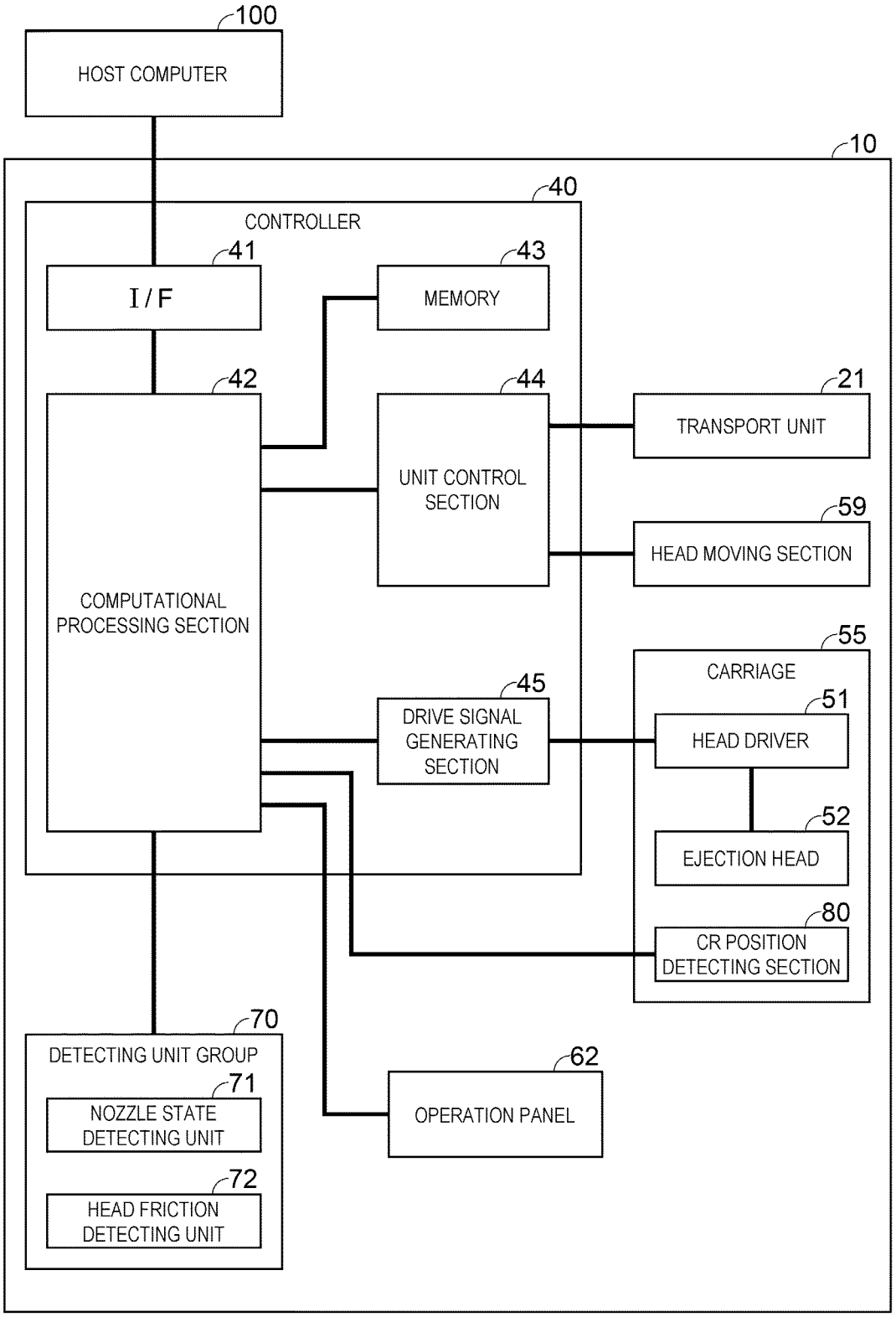
FIG. 5 is a block diagram illustrating a system configuration of a printing apparatus.

A system of the printing apparatus 10 will be described next with reference to FIG. 5. FIG. 5 is a block diagram illustrating the system configuration of the printing apparatus 10. The printing apparatus 10 includes the controller 40, the transport unit 21, the head moving section 59, the carriage 55, the operation panel 62, and a detecting unit group 70.

The controller 40 controls the units of the printing apparatus 10 on the basis of the print data received from the host computer 100, and prints an image corresponding to the print data onto the printing medium S. The controller 40 includes an interface section (I/F) 41, a computational processing section 42 including a Central Processing Unit (CPU) and the like, memory 43, the unit control section 44, and a drive signal generating section 45.

The interface section 41 transmits and receives data between the host computer 100, which is an external device, and the printing apparatus 10. The computational processing section 42 carries out computational processes for controlling the printing apparatus 10 as a whole. The memory 43 stores programs that cause the CPU of the computational processing section 42 to operate, secures a work area for the CPU, and the like, and is a storage device such as Random Access Memory (RAM) or Electrically Erasable Programmable Read-Only Memory (EEPROM).

The unit control section 44 controls the transport unit 21 and the head moving section 59 on the basis of instructions from the computational processing section 42 operating in accordance with programs stored in the memory 43.

The drive signal generating section 45 generates drive signals for driving the ejection head 52, and sends the drive signals to a head driver 51 mounted in the carriage 55. The head driver 51 drives the driving elements of the ejection head 52 on the basis of the drive signals and causes ink droplets to be ejected from the nozzles. As described earlier, the carriage 55 includes the CR position detecting section 80, and the CR position detecting section 80 detects movement of the carriage 55 and transmits a detection result to the computational processing section 42.

The printing apparatus 10 furthermore includes the detecting unit group 70, which includes a nozzle state detecting unit 71 and a head friction detecting unit 72, as a part of a state detecting unit that detects state changes when the printing unit 58 prints an image corresponding to the print data. Detection results from the nozzle state detecting unit 71 and a detector of the head friction detecting unit 72 are transmitted to the computational processing section 42. "When printing an image" refers to a period from when the print data of an image to be printed is received to when the printing of the image corresponding to the print data ends. The nozzle state detecting unit 71 detects whether the ink droplets are being properly ejected from the nozzles in the ejection head 52. For example, the nozzle state detecting unit 71 detects whether the ink droplets are being properly ejected by detecting residual vibrations after the driving elements of the ejection head 52 are driven. Through this, the possibility that an error in which, for example, ink droplets are not ejected during printing (missing dots) has occurred can be detected. The head friction detecting unit 72 includes, in the carriage 55, a piezoelectric film affixed on both sides of the ejection head 52 in the scanning direction and a detector, for example. The head friction detecting unit 72 configured in this manner detects the possibility that the ejection head 52 and the printing medium S have made contact by using the detector to detect changes in the electrical properties of the piezoelectric film produced when the piezoelectric film makes contact with the printing medium S. That is, the head friction detecting unit 72 configured in this manner detects whether the ejection head 52 and the printing medium S have made contact by using the detector. In a case where the ejection head 52 and the printing medium S make contact, image defects will arise in which friction is caused between the ejected ink and the ejection head 52 and smears or the like are produced in the printed image, and thus head friction detection is carried out. Here, "state change" refers to the occurrence of a state in which the quality of the printed image may be affected, and includes, in addition to error detection, the execution of operations producing down time or delay time that do not arise in normal image printing operations. The state detecting unit includes part of the memory 43 for storing whether operations producing down time or delay time that do not arise in normal image printing operations, when printing an image corresponding to print data is carried out. On the basis of a state change detected by the state detecting unit, the controller 40 causes the printing unit 58 to print state change information indicating the contents of the state change onto the medium so that the position in an image where the state change is detected can be determined.

Control of Printing Apparatus

Figure 6A:
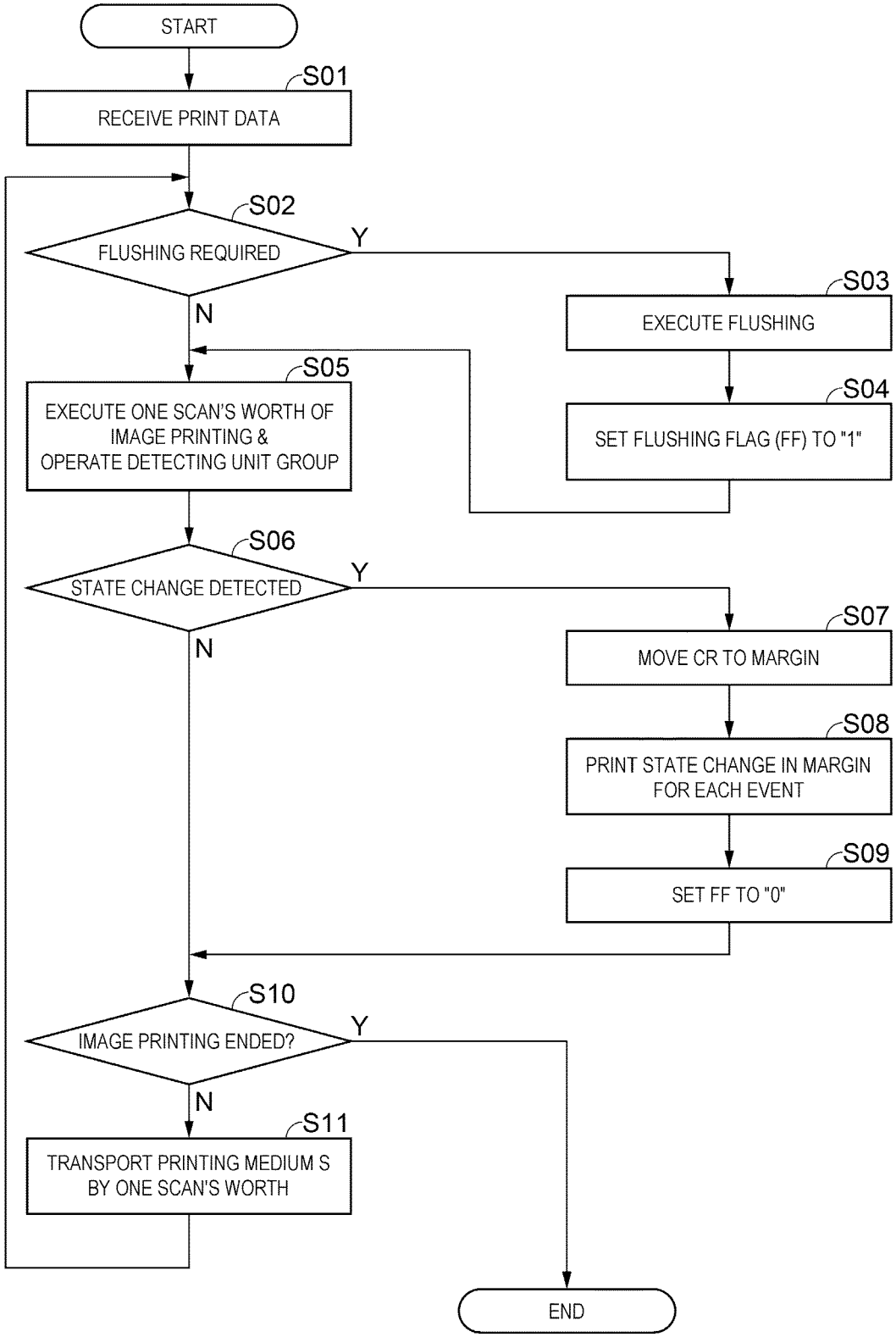
FIG. 6A is a flowchart illustrating an example of a printing method according to the disclosure.

Control of the printing apparatus 10 will be described next with reference to FIG. 6A. FIG. 6A is a flowchart illustrating one example of a printing method according to the disclosure, executed by the computational processing section 42. First, the computational processing section 42 of the printing apparatus 10 receives print data from the host computer 100 through the interface section (I/F) 41 (step S01).

The computational processing section 42 further determines whether flushing operation is necessary to maintain the ejection head 52 in a favorable ejection state (step S02). In a case where flushing operation is necessary (Y in step S02), the process proceeds to step S03, where the flushing operation is executed, whereas in a case where flushing operation is not necessary (N in step S02), the process proceeds directly to step S05. Although one exemplary embodiment describes an example in which the determination as to whether flushing operation is necessary is made after receiving the print data, the timing of the determination as to whether flushing operation is necessary is not limited to this timing, and the determination may be made at any appropriate timing.

"Flushing operation" is an operation in which ink droplets are forcefully ejected from the nozzles of the ejection head 52 to prevent ink from drying in the nozzles and clogging the nozzles, and is one type of maintenance operations for the printing apparatus 10. Although one exemplary embodiment describes the flushing operation as an example of the maintenance operations, the maintenance operations also include suction purging, wiping, capping, and the like. The maintenance operations are carried out at pre-set timings such as when the printing apparatus 10 has not been used for a long period of time, when the printing apparatus 10 is started up and turned off, and when printing is started and stopped, and are carried out when an error pertaining to the ejection head 52, such as missing dots, has been detected. Alternatively, the maintenance operations may be carried out periodically, at predetermined time intervals. As described earlier, the flushing operation is carried out in the flushing section 35 (see FIG. 3) disposed in an area distanced from the printing medium S, and thus image printing is suspended during the flushing operation.

In a case where it has been determined in step S02 that flushing operation is necessary, the computational processing section 42 controls the drive signal generating section 45 to generate a drive signal that drives the ejection head 52 and executes the flushing operation (step S03). Furthermore, a flushing flag (FF) indicating that the flushing operation has been executed is set (step S04), and the process then proceeds to step S05. In other words, the flushing flag (FF) is set to 1, and the process proceeds to step S05.

Next, on the basis of the print data, the computational processing section 42 controls the operations of the transport unit 21 and the head moving section 59 through the unit control section 44 while referring to the detection result from the CR position detecting section 80, controls the head driver 51 through the drive signal generating section 45 to cause ink droplets to be ejected from the nozzles in the ejection head 52, and prints one scan's worth of an image (step S05). In one exemplary embodiment, the ejection head 52 includes 400 nozzles in each row, and is thus capable of forming 400 lines' worth of the image in a single scan. In addition to the image printing, state changes arising during the image printing operations (ink droplet ejection errors, friction of the ejection head 52, and the like) are detected at this time by operating the detecting unit group 70, including the nozzle state detecting unit 71 and the head friction detecting unit 72 (step S05).

Next, the computational processing section 42 detects whether a state change including the execution of flushing operation has been detected (step S06). In other words, the computational processing section 42 confirms whether the flushing flag (FF) is set, or whether the detecting unit group 70 has detected an error in the image printing operations. In a case where a state change has been detected (Y in step S06), the process proceeds to step S07, whereas in a case where a state change has not been detected (N in step S06), the process proceeds to step S10. Although the above-described maintenance operations, including the flushing operation, are operations executed by the computational processing section 42 as required by the computational processing section 42, the maintenance operations are not included in normal image printing and are thus treated as a state change. In other words, a process of recognizing that maintenance operations have been executed and the printing suspended (i.e., FF=1) is also referred to as "detecting a state change". Note that the flushing flag (FF) may also be set when operations producing down time or delay time, such as maintenance operations aside from the flushing operation, are carried out.

In a case where a state change has been detected (Y in step S06), the computational processing section 42 moves the carriage 55 to the non-image formation region (a margin to a side of the printed image) on a line extending in the scanning direction from the point where the one scan's worth of image printing has ended by controlling the head moving section 59 through the unit control section 44 (step S07).

Figure 7A:
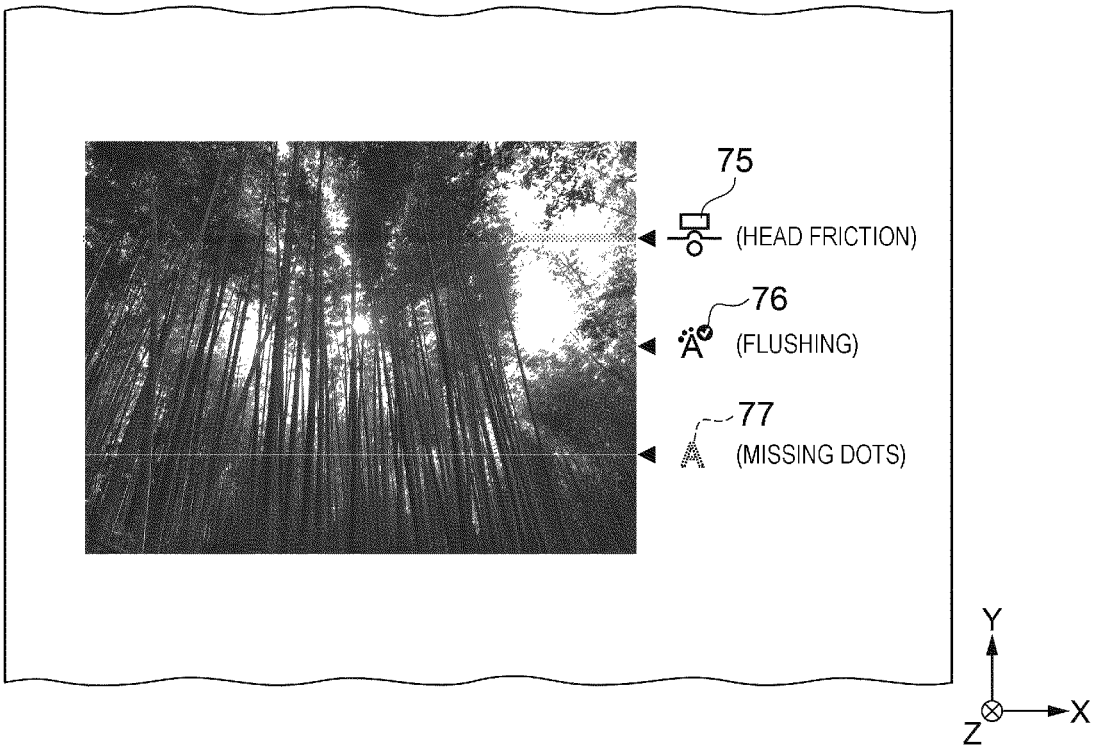
FIG. 7A illustrates an example of a printed result of state change information.

Next, the computational processing section 42 prints state change information corresponding to the state change detected in step S06 (step S08). The flushing flag (FF) is then set to 0 (step S09), and the process proceeds to step S10. FIG. 7A illustrates one example of the state change information printed in this manner. In step S08, state change information corresponding to the state change detected when printing the one scan's worth of the image is printed in the margin to a side of the image as graphical information (an event mark) and text information, as illustrated in FIG. 7A. To describe in more detail, when the head friction detecting unit 72 has detected that the ejection head 52 and the printing medium S may have come into contact, an event mark 75 serving as the graphical information and "head friction" serving as the text information are printed to the side of the one scan's worth of the image when the contact was detected. Likewise, in a case where the execution of the flushing operation has been detected (i.e., if the FF being 1 has been detected), an event mark 76 and text information of "flushing" are printed. In a case where the nozzle state detecting unit 71 has detected that missing dots may have occurred, an event mark 77 and text information of "missing dots" are printed. Thus, state change information corresponding to a state change detected during image printing is printed to the side of one scan's worth of the image when the state change is detected, and thus the position where the state change may have occurred can be identified in the printed image (the printed material). That is, the state change information is associated with a position in the image where the state change is detected.

Next, the computational processing section 42 confirms whether printing has ended for all of the print data (step S10). In a case where all of the printing has ended (Y in step S10), the process is ended, or proceeds to the printing process for the next image. In a case where all of the printing has not ended (N in step S10), the computational processing section 42 advances to the next image formation region by transporting the printing medium S by one scan's worth (e.g., 400 lines' worth) (step S11), returns to step S02, and carries out the printing process for the next scan.

In the flowchart in FIG. 6A, the printing of image is a process in which the printing apparatus 10 prints an image corresponding to obtained print data onto the printing medium S, and corresponds to the processing from step S01 to step S11. The detecting of state is a process in which a state change is detected while the printing apparatus is operating during the printing an image (the flushing operation being executed, a detection being made by the detecting unit group 70, and the like), and corresponds to the processing from step S02 to step S06. The printing of information is a process in which the state change information is printed onto the printing medium S, based on a state change detected in the detecting of state, and corresponds to the processing of step S07 and step S08. Accordingly, in one exemplary embodiment, the detecting of state and the printing of information are executed during the printing of image, and when a state change is detected in the detecting of state while the printing apparatus 10 is carrying out printing operations, the state change information is printed in the printing of information onto the printing medium S in a manner that a position in the image is identifiable where the state change is detected, each time the state change is detected. Accordingly, the position where the state change is detected can be determined from the position where the state change information is printed. That is, the state change information is associated with a position in the image where the state change is detected.

Advantages

As described above, according to one exemplary embodiment, presence of a state change is confirmed each time one scan's worth of an image is printed, and the state change information is printed in the margin to a side of the image each time the state change is detected. The state change information is printed using graphics and text so that the contents of the state change can be identified. Thus, the user can quickly and visually confirm what the state change (printing defect) may have occurred at which position in the printed image. In particular, the contents of the state change are printed as graphics (an event mark), thus the user can quickly and intuitively understand what the state change may have occurred. Accordingly, the user can take particular care to confirm the printed material at the position where the state change information is printed by paying attention to the contents of the printing defect that may have occurred. The possibility in that a printing defect will be overlooked is reduced as a result. Note that the state change information may be printed only as graphics or only as text, as long as the contents of the state change can be identified. It is desirable, in terms of confirming a position where a defect may have occurred, the state change information is preferred to be printed to the side of one scan's worth of the image when the state change has been detected, but the state change information may be printed at the time of another scan. Because it is sometimes necessary to take time from detecting the state change to generating the print data of the state change information, thus by printing the state change information at the time of another scan, a sufficient time for generating the print data of the state change information can be secured under continuing the printing. However, it is desirable to print the state change information in a position as close as possible to the scan where the state change is detected.

Although an exemplary embodiment of the disclosure has been described thus far, many modifications can be made without departing from the essential spirit of the disclosure, as will be described next.

Modified Example 1

Figure 7B:
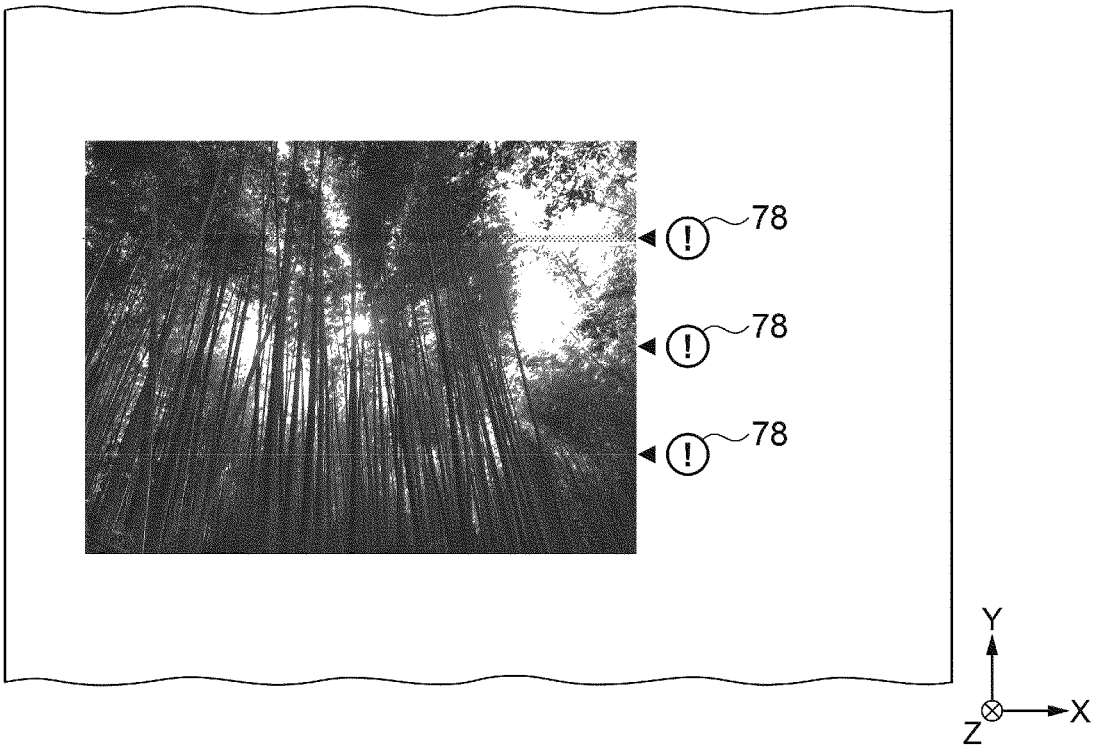
FIG. 7B illustrates another example of a printed result of state change information.

FIG. 7B illustrates another example of a printed result of the state change information. The printed result illustrated in FIG. 7B is generated through processing based on the flowchart of FIG. 6A, in the same manner as the printed result illustrated in FIG. 7A. However, at the printing of the state change information in step S08, the state change information is printed as an event mark 78, and text information is not printed. The event mark 78 is printed in the margin to the side of the image each time a state change is detected, and thus the user can know the position of the state change in the printed image with certainty. Accordingly, the user can take particular care to confirm the printed material at the position where the event mark 78 is printed for a printing defect that may have occurred. The possibility that a printing defect will be overlooked is reduced as a result. Furthermore, the text information is not printed, and thus the non-image formation region (the margin to the side of the printed image) can be made smaller, and the printing medium S can be efficiently used to print the image. Although in Modified Example 1, the position of the state change is indicated only by the single event mark 78 serving as the graphical information, different event marks can be printed in accordance with the contents of the state change, as with the event marks 75, 76, and 77 illustrated in FIG. 7A, while not printing the text information.

Modified Example 2

Figure 6B:
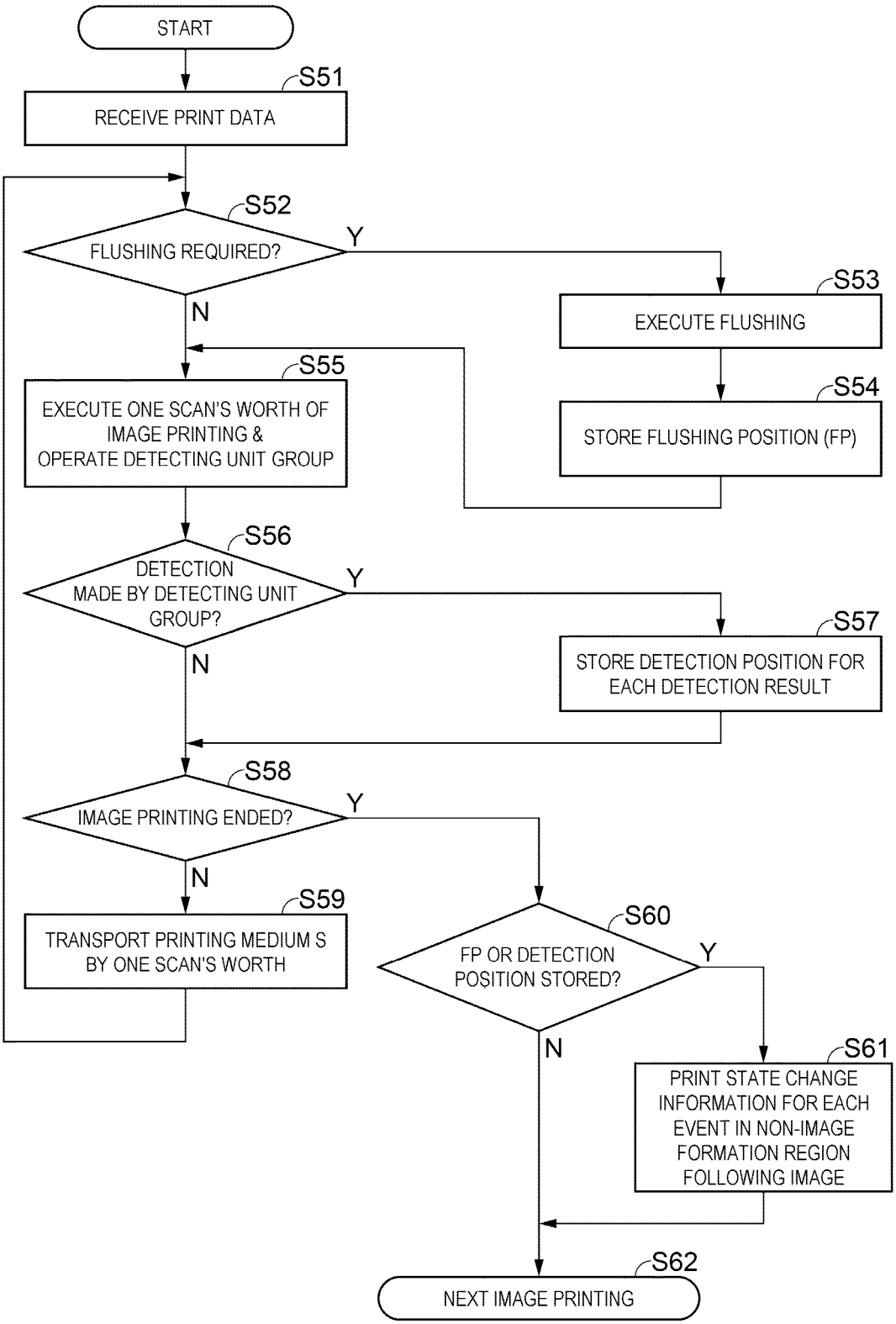
FIG. 6B is a flowchart illustrating another example of a printing method according to the disclosure.
Figure 8:
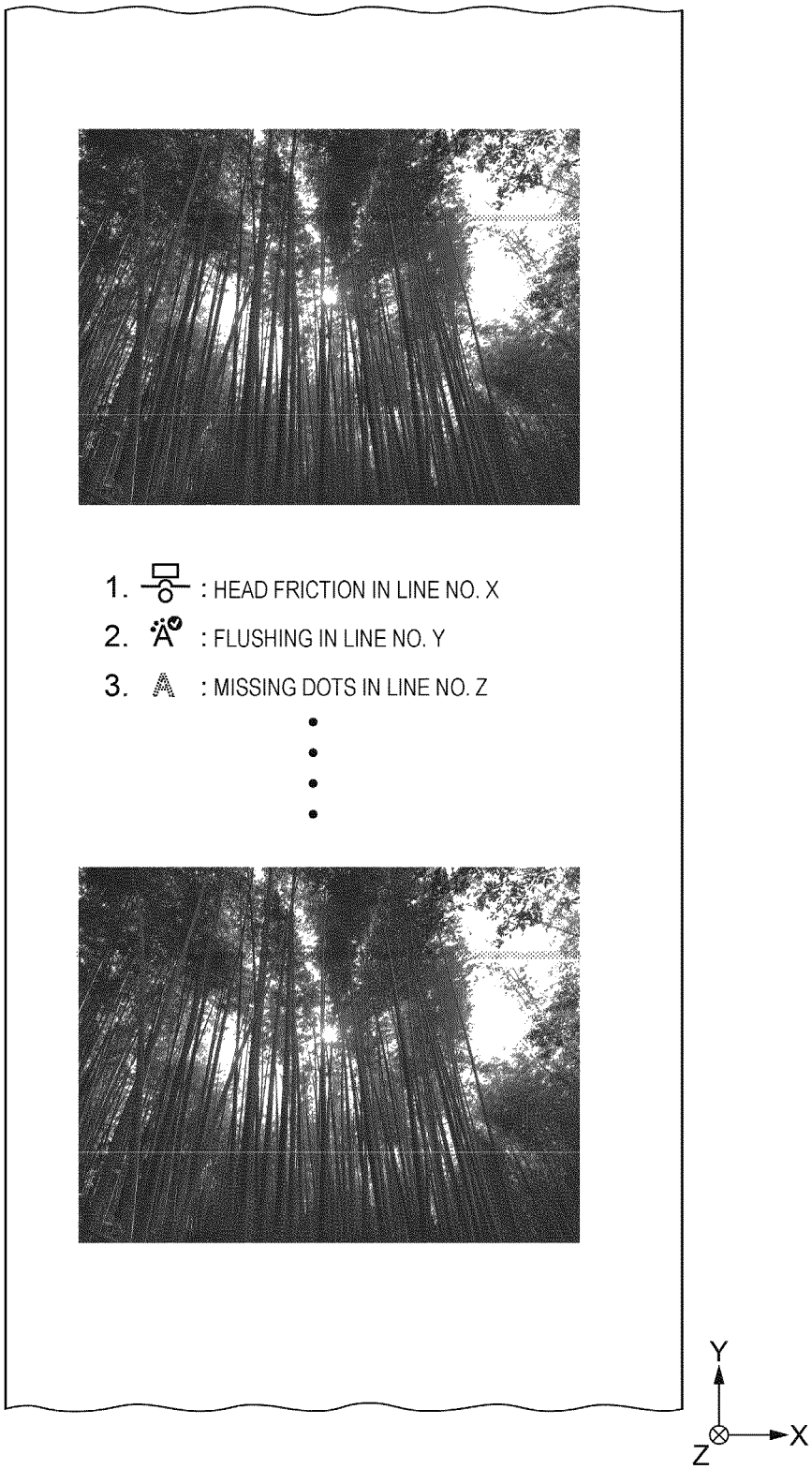
FIG. 8 illustrates still another example of a result of printing state change information.

FIG. 6B is a flowchart illustrating another example of a printing method according to the disclosure, executed by the computational processing section 42. FIG. 8 illustrates still another example of the printed result of the state change information, and it is a printed result of the state change information processed on the basis of the flowchart in FIG. 6B.

In FIG. 6B, step S51 to step S53 are the same as step S01 to step S03 in FIG. 6A, and thus these steps will not be described. Upon the flushing operation being executed in step S53, the computational processing section 42 stores the position where the flushing operation have been executed (FP) in the printed image (the printed material) in the memory 43 (step S54), and the process then proceeds to step S55.

Step S55, which follows step S52 or step S54, is the same as step S05 in FIG. 6A, and thus will not be described. After step S55, the computational processing section 42 confirms whether a detection has been made by the detecting unit group 70 (step S56). As a result, in a case where a detection has been made (Y in step S56), the computational processing section 42 stores the position in the printed image (printed material) where the detection has been made in the memory 43 (step S57), and the process then proceeds to step S58. However, in a case where a detection has not been made (N in step S56), the process proceeds directly to step S58.

Step S58 and step S59 are the same as step S10 and step S11 in FIG. 6A, and thus these steps will not be described. In a case where in step S58 it is determined that the printing has ended for all of the print data (Y in step S58), the process proceeds to step S60.

In step S60, it is confirmed whether at least one of a position where a flushing operation has been executed (FP) and a position where a detection has been made by the detecting unit group 70 is stored in the memory 43. In a case where the confirmation result is negative (N in step S60), the printing process is ended, or the process proceeds to the next image printing (step S62). Here, "the next image printing" refers to returning to step S52 and printing the same image in a case where continuous printing of the same image is set, or, returning to step S51, receiving the print data of a new image, and printing the new image in a case where new image printing is set. Note that the process of step S62 may be applied to the process "END" in FIG. 6A to implement processing for continuously printing the same image or a different image.

On the other hand, in a case where the confirmation result is positive (Y in step S60), the state change information corresponding to the state change stored in the memory 43 (the execution of the flushing operation; the detection by the detecting unit group 70) is printed after the image for which printing has ended (step S61). Specifically, as illustrated in FIG. 8, the state change information is numbered and is printed in an area following the printed image as graphical information (event marks), the line number where the state change has occurred, and text information indicating the contents of the state change. Note that in a case where a state change has been detected while the image is printed during scanning, the position where the state change has been detected in the width direction of the printing medium S may also be printed. The total number of detected state changes may be printed, and the number of occurrences may be printed in each instance in the contents of the state change. When printing in each instance in the contents of the state change, graphics that enable the contents of the state change to be identified may be used. When the printing of the state change information ends, the process proceeds to the printing of the next image (step S62). Note that a positive confirmation result indicates that some state change has occurred while printing an image, and that some image defect may have occurred in the printed image. Thus, the printing process may be ended without carrying out the process for printing the next image.

In the flowchart in FIG. 6B, the printing of image is a process in which the printing apparatus 10 prints an image corresponding to obtained print data onto the printing medium S and corresponds to the process of step S51 to step S59. The detecting of state is a process in which a state change is detected while the printing apparatus is operating in the printing of image (a flushing operation being executed, a detection being made by the detecting unit group 70, and the like), and corresponds to the processing from step S52 to step S57. The printing of information is a process in which the state change information is printed onto the printing medium S on the basis of a state change detected in the detecting of state and corresponds to the processing of step S60 and step S61. Thus, in Modified Example 2, the detecting of state is executed during the printing of image, and when a state change is detected in the detecting of state while the printing apparatus 10 is carrying out printing operations, the position where the state change is detected is stored in the memory 43 each time a state change is detected. After the end of the printing of image, the printing of information includes printing the state change information onto the printing medium S in a manner that the position in the image is determinable where the state change is detected. That is, the state change information is associated with a position in the image where the state change is detected. Accordingly, the position where the state change is detected can be determined (read) from the state change information.

Furthermore, according to Modified Example 2, the state change information is printed after the printed image, thus the image can be printed across the entire width of the printing medium S. The printing medium S can therefore be efficiently used to print the image. Furthermore, a greater area for printing the state change information can be secured, and thus more detailed state change information can be printed. Additionally, in the flowchart of FIG. 6A and the flowchart of FIG. 6B, the printing of image may print an image by ejecting ink droplets (liquid droplets), and the detecting of state may detect the possibility in that ink droplets (liquid droplets) have not been ejected. In other words, the detecting of state includes detecting an error in which ink droplets (liquid droplets) have not been ejected. Furthermore, the detecting of state may detect an interrupt of printing due to maintenance operations for the printing apparatus 10.

Further still, the detecting of state may detect the possibility in that the ejection head 52 ejecting ink droplets (liquid droplets) has contacted with the printing medium S. In other words, the detecting of state includes detecting whether the ejection head 52 ejecting ink droplets has contacted with the printing medium S.

Although an exemplary embodiment and modified examples of the disclosure have been described thus far, the disclosure is not intended to be limited to the above-described exemplary embodiment or modified examples, and can be realized through a variety of configurations in a scope that does not depart from the essential spirit of the disclosure. For example, the technical features of the exemplary embodiment and modified examples can be interchanged, combined, and the like as appropriate to address all or part of the above-described issues or to achieve all or part of the above-described effects. The printing apparatus described in these descriptions can be used to print shapes, patterns, and the like onto fabrics used for clothing, posters, signs (billboards, placards, and the like), horizontal and vertical banners, wrapping sheets (e.g., for wrapping cars), and the like.

This application claims priority under 35 U.S.C. § 119 to Japanese Patent Application No. 2017-137773, filed Jul. 14, 2017. The entire disclosure of Japanese Patent Application No. 2017-137773 is hereby incorporated herein by reference.

What is claimed is:

1. A printing method comprising:

printing an image onto a medium while scanning an ejection head in a scan direction, the ejection head being configured to eject liquid droplets onto the medium;

detecting a state change for each scan during the printing of the image; and printing state change information corresponding to the state change onto the medium, responsive to detecting the state change, wherein the state change information is printed so as not to overlap with a printed area of the image; and the state change information is associated with a position in the image where the state change is detected.

2. The printing method according to claim 1, wherein the state change information indicates what state change occurred.

3. The printing method according to claim 2, wherein detecting the state change includes detecting an error in which the liquid droplets have not been ejected.

4. The printing method according to claim 2, wherein detecting the state change includes detecting an interrupt of printing due to a maintenance operation.

5. The printing method according to claim 2, wherein detecting the state change includes detecting whether the ejection head ejecting liquid droplets has contacted with the medium.

6. The printing method according to claim 2, further comprising printing respective state change information including the state change information each of a plurality of times any state change is detected.

7. The printing method according to claim 2, wherein printing the state change information is performed after the image is printed.

8. The printing method according to claim 2, wherein the state change information includes text.

9. The printing method according to claim 8, wherein the text includes a line number of each scan where the state change occurred and contents of the state change.

10. The printing method according to claim 2, wherein the state change information includes a graphic.

11. The printing method according to claim 1, wherein detecting the state change includes detecting an error in which the liquid droplets have not been ejected.

12. The printing method according to claim 1, wherein detecting the state change includes detecting an interrupt of printing due to a maintenance operation.

13. The printing method according to claim 1, wherein detecting the state change includes detecting whether the ejection head ejecting liquid droplets has contacted with the medium.

14. The printing method according to claim 1, further comprising printing respective state change information including the state change information each of a plurality of times any state change is detected.

15. The printing method according to claim 1, wherein printing the state change information is performed after the image is printed.

16. The printing method according to claim 1, wherein the state change information includes text.

17. The printing method according to claim 16, wherein the text includes a line number of each scan where the state change occurred and contents of the state change.

18. The printing method according to claim 1, wherein the state change information includes a graphic.

19. A printing apparatus comprising:

a printing unit configured to print an image onto a medium while scanning an ejection head in a scan direction, the ejection head being configured to eject liquid droplets onto the medium;

a state detecting unit configured to detect a state change while the printing unit prints the image; and a controller configured to cause the printing unit to print state change information corresponding to the state change onto the medium, responsive to detecting the state change, such that the state change information is printed so as not to overlap with a printed area of the image, wherein the state change information is associated with a position in the image where the state change is detected.

20. The printing apparatus according to claim 19, wherein the state change information includes text, and the text includes a line number of each scan where the state change occurred and contents of the state change.

* * * * *